US006357647B1

(12) United States Patent
Ou

(10) Patent No.: US 6,357,647 B1
(45) Date of Patent: Mar. 19, 2002

(54) NAIL-DRIVING GUN HAVING A SINGLE SHOT OPERATION AND A CONTINUOUS SHOOTING OPERATION WHICH CAN BE SELECTED BY CONTROLLING ACUTATION ORDER OF TWO MEMBERS

(75) Inventor: Chen-He Ou, Tou-Liu (TW)

(73) Assignee: Panrex Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 09/864,054

(22) Filed: May 23, 2001

(51) Int. Cl.[7] ..... B25C 1/04
(52) U.S. Cl. ..... 227/8; 227/10
(58) Field of Search ..... 227/8, 130

(56) References Cited

U.S. PATENT DOCUMENTS 5,551,621 A * 9/1996 Valles ..... 227/130
5,692,663 A * 12/1997 Yang ..... 227/8
5,791,545 A * 8/1998 Lin ..... 227/130
5,797,533 A * 8/1998 Lee ..... 227/8
5,836,501 A * 11/1998 Lai ..... 227/8
5,862,969 A * 1/1999 Lee ..... 227/130
6,059,161 A * 5/2000 Chang et al. ..... 227/130
6,116,488 A * 9/2000 Lee ..... 227/8
6,213,372 B1 * 4/2001 Chen ..... 227/8

* cited by examiner

*Primary Examiner*—Scott A. Smith
(74) *Attorney, Agent, or Firm*—Brooks & Kushman P.C.

(57) ABSTRACT

A nail-driving gun includes a safety rod disposed movably on a front end of a barrel, and a trigger member disposed movably on a handle. Upon actuation of the safety rod and the trigger member, the barrel shoots a nail therefrom. When the safety rod is pressed against a wall prior to actuation of the trigger member, the gun can be operated in a single shot mode, in which the safety rod is prevented from returning to its original position due to a hook member that is attached to the trigger member. When the safety rod is pressed against the wall after actuation of the trigger member, the gun can be operated in a continuous shooting mode. The safety rod and the trigger member can be actuated by one hand that holds the handle.

4 Claims, 7 Drawing Sheets

NAIL-DRIVING GUN HAVING A SINGLE SHOT OPERATION AND A CONTINUOUS SHOOTING OPERATION WHICH CAN BE SELECTED BY CONTROLLING ACUTATION ORDER OF TWO MEMBERS

BACKGROUND OF THE INVENTION

1. Field of the Invention

This invention relates to a nail-driving gun, more particularly to a nail-driving gun, which can be operated pneumatically in a single shot mode or a continuous shooting mode that are selected by controlling the actuation order of a safety rod and a trigger member.

2. Description of the Related Art

The improvement of this invention is directed to a conventional nail-driving gun, which can be operated pneumatically by reciprocating a valve rod in a single shot mode or a continuous shooting mode that are selected by actuating a switching member. When such a nail-driving gun is in use, because a handle of the gun is held with one hand, it is necessary to actuate the switching member with the other hand, thereby resulting in difficulties during operation of the gun. Furthermore, the trigger member is disposed adjacent to the valve rod so that the setback force of the gun may move untimely the valve rod. As such, it is possible to form two consecutive shots even if the switching member is set at the single shot mode.

SUMMARY OF THE INVENTION

An object of this invention is to provide a nail-driving gun for performing a single shot operation and a continuous shooting operation, which can be selected by controlling the actuation order of two members, the members being capable of being actuated easily with one hand that holds a handle of the gun.

Another object of this invention is to provide a nail-driving gun, which can prevent formation of two consecutive shots when the gun is operated in a single shot mode.

According to this invention, a nail-driving gun includes a safety rod disposed movably on a front end of a barrel, and a trigger member disposed movably on a handle. Upon actuation of the safety rod and the trigger member, the barrel shoots a nail therefrom. When the safety rod is pressed against a wall prior to actuation of the trigger member, the gun can be operated in a single shot mode, in which the safety rod is prevented from returning to its original position due to a hook member that is attached to the trigger member. When the safety rod is pressed against the wall after actuation of the trigger member, the gun can be operated in a continuous shooting mode. The safety rod and the trigger member are actuated by one hand that holds the handle.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
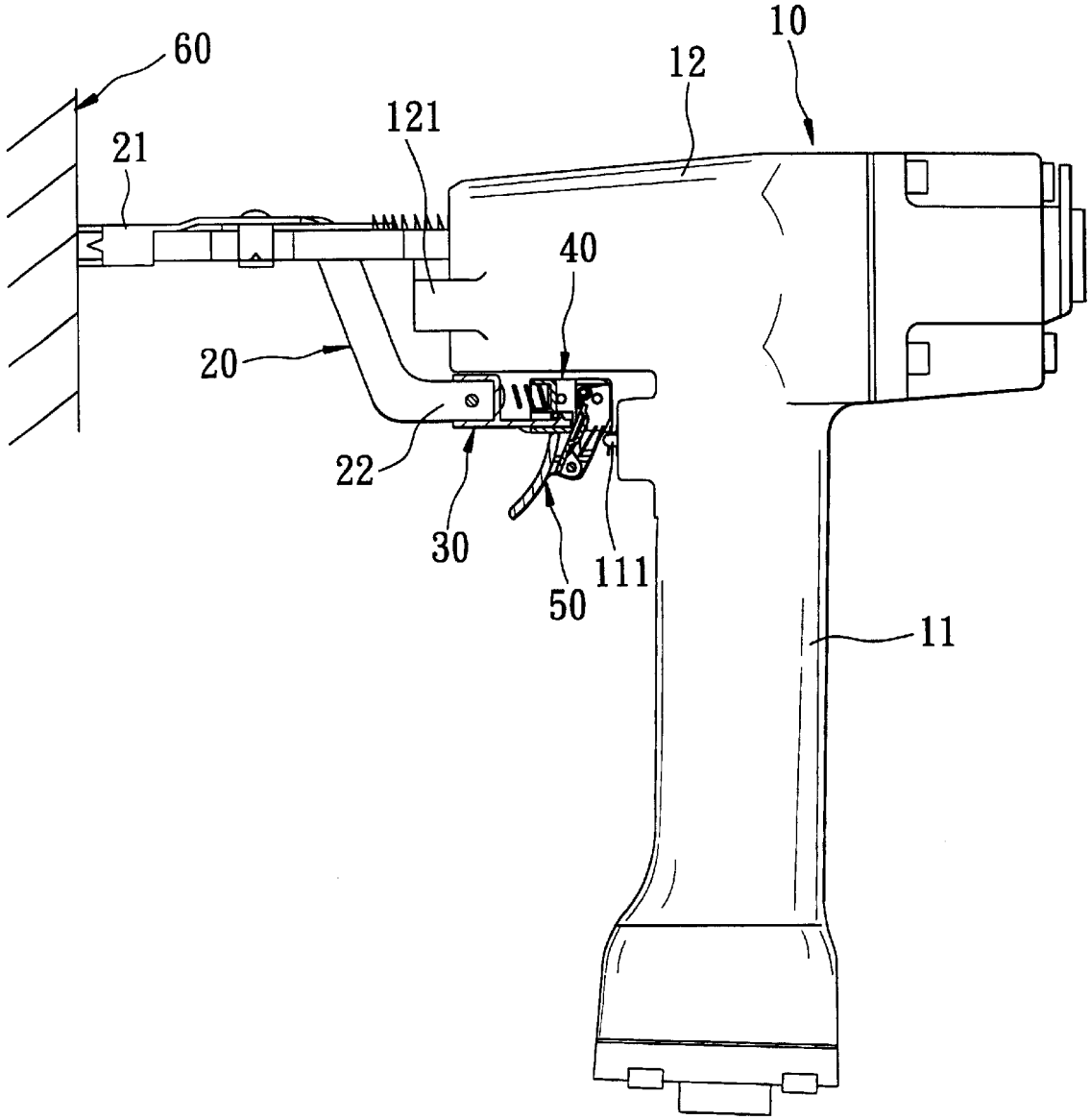
FIG. 1 is a schematic side view of the preferred embodiment of a nail-driving gun according to this invention.
Figure 2:
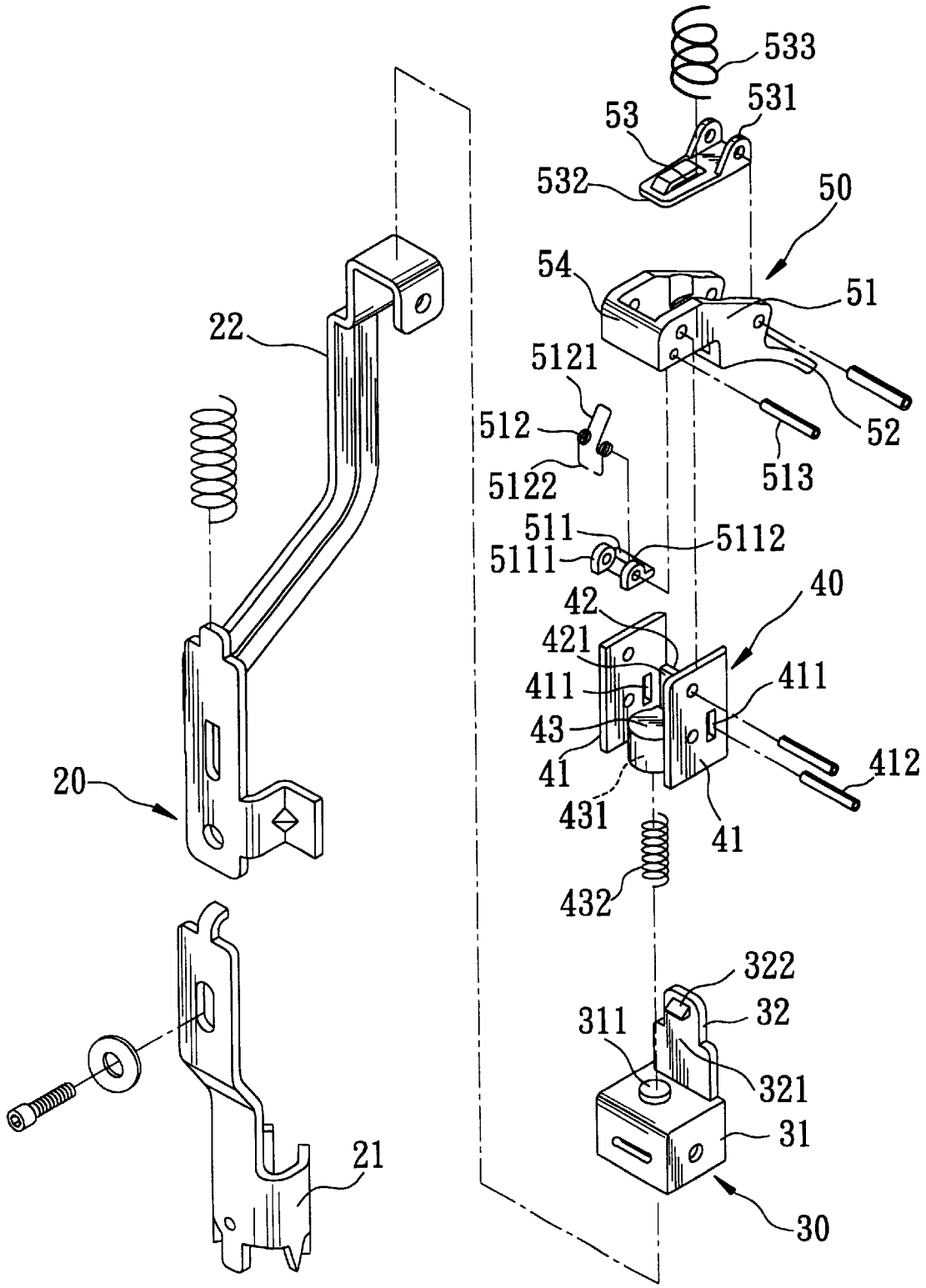
FIG. 2 is an exploded perspective view of a portion of the preferred embodiment.
Figure 3:
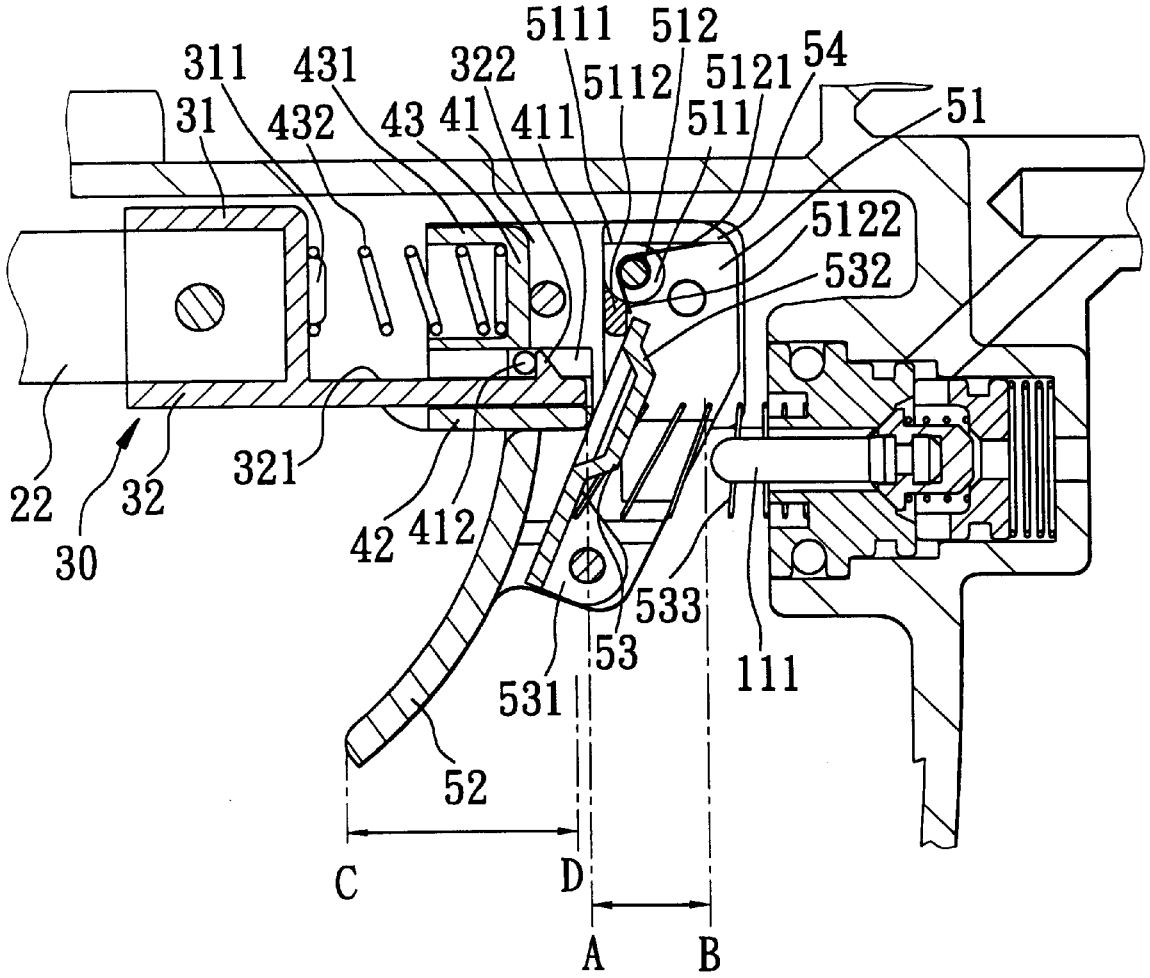
FIG. 3 is a fragmentary sectional view of the preferred embodiment, in which a press member, an actuation lever and a valve rod are disposed at their normal positions.

Referring to FIGS. 1, 2 and 3, the preferred embodiment of a nail-driving gun according to this invention is shown to include a gun body 10, a safety rod 20, a press member 30, a positioning seat 40 and a trigger assembly 50.

The gun body 10 includes a handle 11 and a barrel 12. The handle 11 is provided with a spring-biased valve rod 111 that is biased to a non-compressing position shown in FIG. 3 and that is movable to a compressing position shown in FIG. 5. The barrel 12 has a rear portion that is attached to the handle 11, and a front portion with a nail-shooting seat 121 that is associated with the valve rod 111 in a known manner. When the valve rod 111 moves from the non-compressing position shown in FIG. 3 to the compressing position shown in FIG. 5, a nail is shot from the nail-shooting seat 121, and is driven into a wall 60. To perform a subsequent nail shooting operation, it is necessary to return the valve rod 111 to the non-compressing position and to move the same from the non-compressing position to the compressing position one more time.

The safety rod 20 is disposed movably on a front end of the barrel 12, and has a front end that abuts against the wall 60, and a rear end that is connected fixedly to a front end of the press member 30.

The positioning seat 40 includes two parallel side plates 41, a bottom plate 42, and a limiting member 43. The side plates 41 are disposed fixedly on the barrel 12, and are formed respectively with a pair of aligned slide slots 411 that receive slidably a slide rod 412 therein. The bottom plate 42 is connected fixedly to and is perpendicular to the side plates 41. The limiting member 43 interconnects the side plates 41 fixedly, and is spaced apart from the bottom plate 42.

The press member 30 includes a front casing element 31 and a rear pressing section 32, which is shaped as a plate that is superimposed on the bottom plate 42 of the positioning seat 40 and that is received fittingly and movably within a space between the bottom wall 42 and the limiting member 43. The pressing section 32 has a surface 321, which is formed with a fixed barb 322 that is disposed behind the slide rod 412, thereby preventing forward removal of the press member 30 from the positioning seat 40.

The limiting member 43 of the positioning seat 40 has a front surface, which is formed with a recess 431. A biasing unit is configured as a coiled compression spring 432, which has a front end that is sleeved fixedly on a rearwardly extending integral projection 311 of the front casing element 31 of the press member 30, and a rear end that is confined within the recess 431 in the limiting member 43 so as to bias the press member 30 away from the positioning seat 40. Accordingly, the press member 30 is biased to a front limit position (A) shown in FIG. 3. When the front end of the safety rod 20 is pressed forcibly against the wall 60, the press member 30 moves relative to the barrel 12 to a rear limit position (B) shown in FIG. 4, where the front casing element 31 of the press member 30 abuts against the limiting member 43 of the positioning seat 40 so as to prevent further rearward movement of the press member 30.

The trigger assembly 50 includes a trigger member 51 with a fixed actuation lever 52, a pushing plate 53, and a stop element 54 that is formed integrally on the trigger member 51. The trigger member 51 is disposed pivotally on the side plates 41 of the positioning seat 40. The actuation lever 52 is biased to a non-actuated position (C) shown in FIG. 3, and can be pressed so as to rotate to an actuated position (D) shown in FIG. 5, which is located behind the non-actuated position (C). The trigger member 51 is provided with a hook member 511, which is disposed rotatably thereon by means of a pivot pin 513 and which is biased to rotate in a direction by means of a torsion spring 512. The torsion spring 512 has a first end 5121 that presses against the stop element 54, and a second end 5122 that presses against the hook member 511. As such, a free end 5112 of the hook member 511 is biased by the torsion spring 512 to rotate clockwise so that an abutment face unit 5111 of the hook member 511 contacts the stop element 54. Contact between the abutment face unit 5111 and the stop element 54 can prevent further clockwise rotation of the hook member 511. The pushing plate 53 is formed with two integral lugs 531 that are disposed pivotally on the trigger member 51, and is located in front of the valve rod 111. A free end 532 of the pushing plate 53 is biased by a spring 533 away from the valve rod 111 to abut against the pressing section 32 of the press member 30. In addition, the spring 533 biases the actuation lever 52 of the trigger member 51 to the non-actuated position (C).

Figure 4:
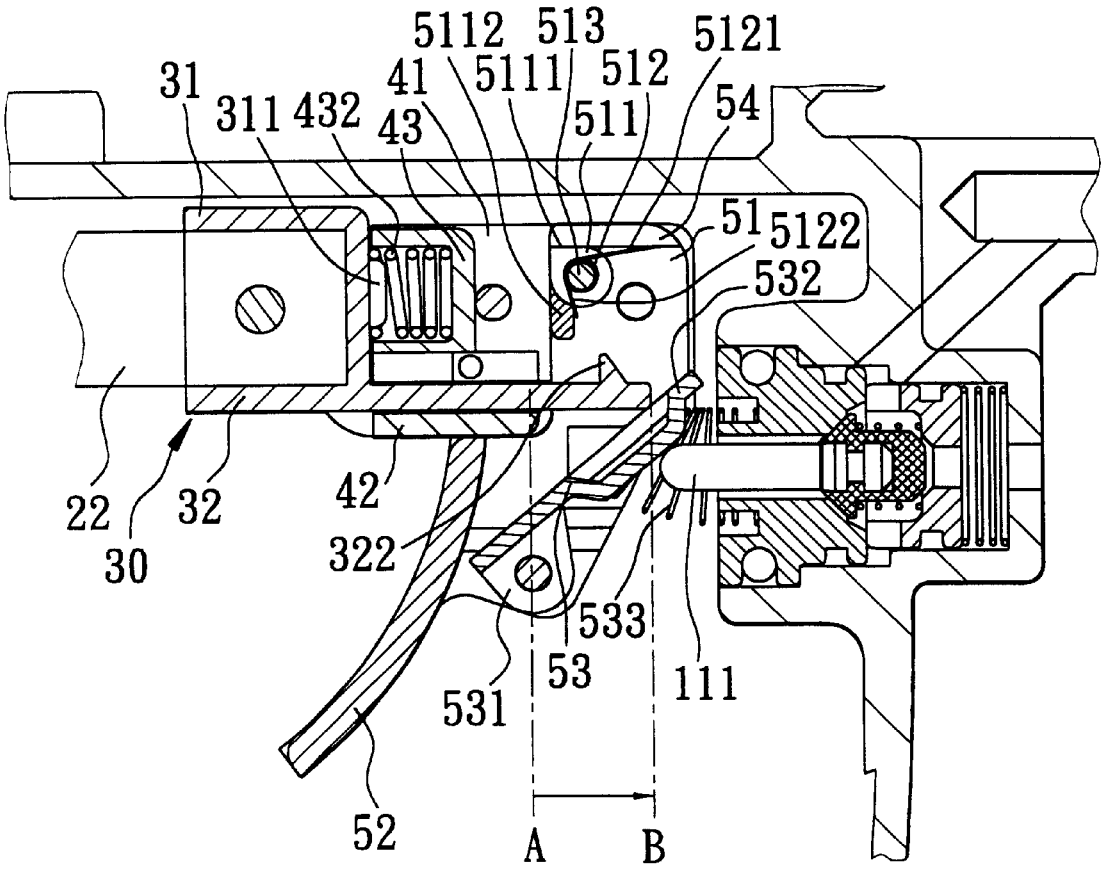
FIG. 4 is a fragmentary sectional view of the preferred embodiment, in which the press member moves to a rear limit position during a single shot operation.
Figure 5:
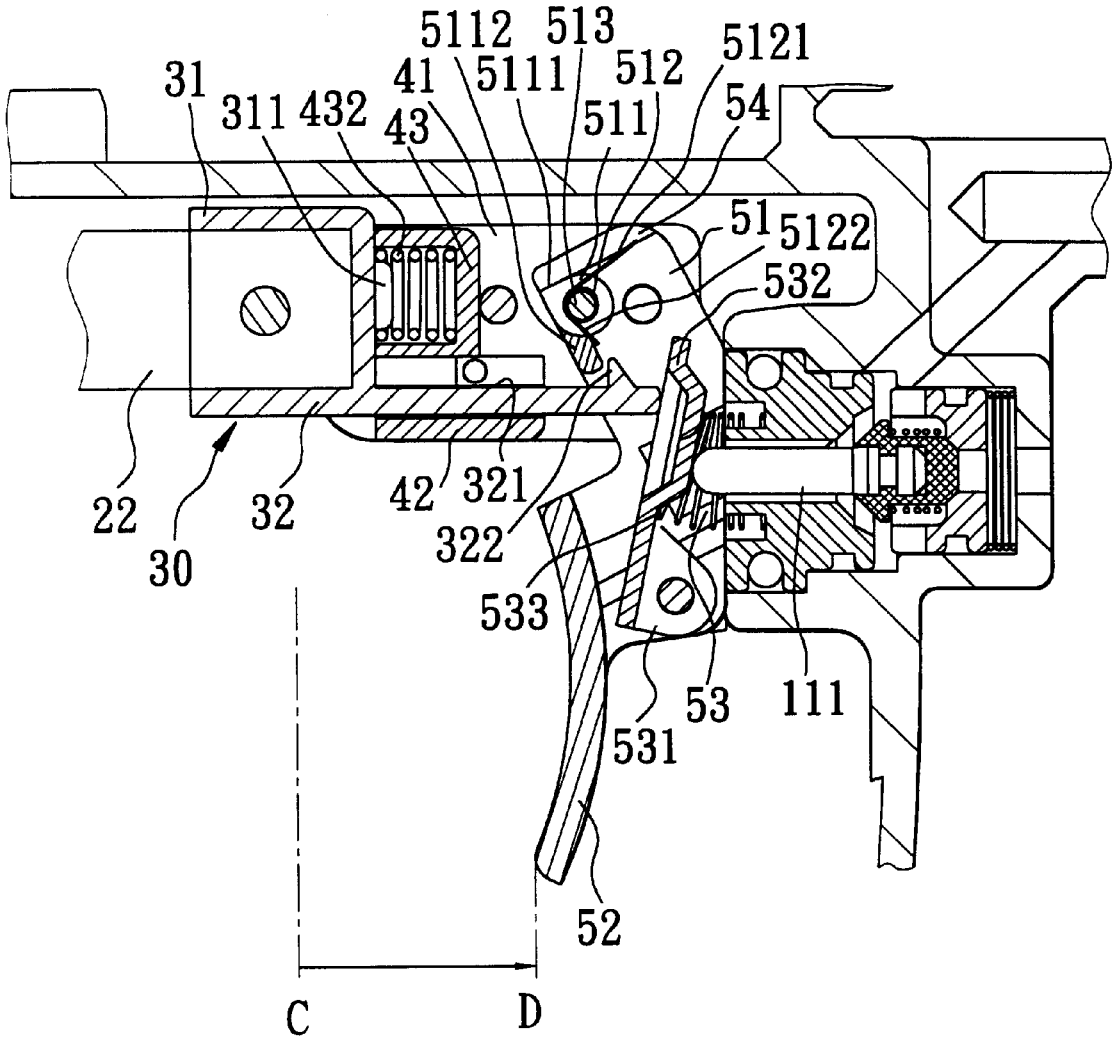
FIG. 5 is a fragmentary sectional view of the preferred embodiment, in which the trigger member moves to an actuated position after the press member moves to the rear limit position during the single shot operation.

When it is desired to perform a single shot operation, the safety rod 20 is pressed against the wall 60 so as to move the press member 30 to the rear limit position (B), as shown in FIG. 4, where the free end 532 of the pushing plate 53 rotates clockwise to abut against the valve rod 111. Subsequently, the actuation lever 52 is pressed rearward to the actuated position (D), as shown in FIG. 5, so that the valve rod 111 moves rearward to the compressing position, thereby shooting the nail from the seat 121. Referring to FIG. 5, because the press member 30 is disposed at the rear limit position (B) (see FIG. 4), when the actuation lever 52 moves from the non-actuated position (C) to the actuated position (D), the trigger member 51 rotates counterclockwise so that the free end 5112 of the hook member 511 turns to a position that is adjacent to and that is located in front of the barb 322, thereby preventing forward movement of the valve rod 111 back to the non-compressing position. At this time, because the valve rod 111 cannot return to the non-compressing position, an unintentional subsequent nail shooting operation resulting from a setback force of the gun after a previous nail shooting operation is prevented as long as the actuation lever 52 is retained at the actuated position (D). Accordingly, two consecutive shots can be avoided during a single shot operation. When the actuation lever 52 is released so as to return to the non-actuated position (C), the hook member 511 turns to the position shown in FIG. 4, where the press member 30 will be biased by the spring 432 to the position shown in FIG. 3, thereby permitting a subsequent single shot operation.

Figure 6:
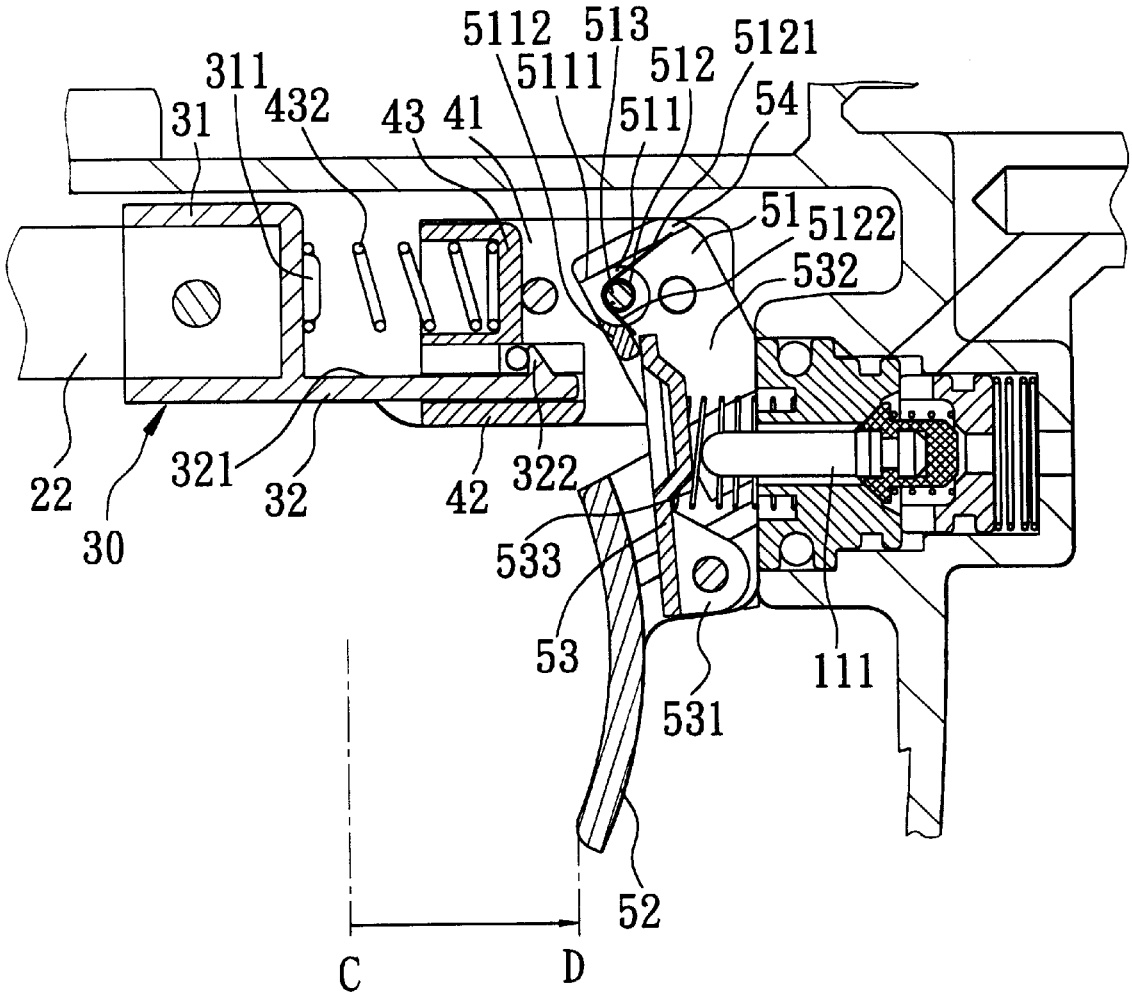
FIG. 6 is a fragmentary sectional view of the preferred embodiment, in which the trigger member moves to the actuated position during a continuous shooting operation.
Figure 7:
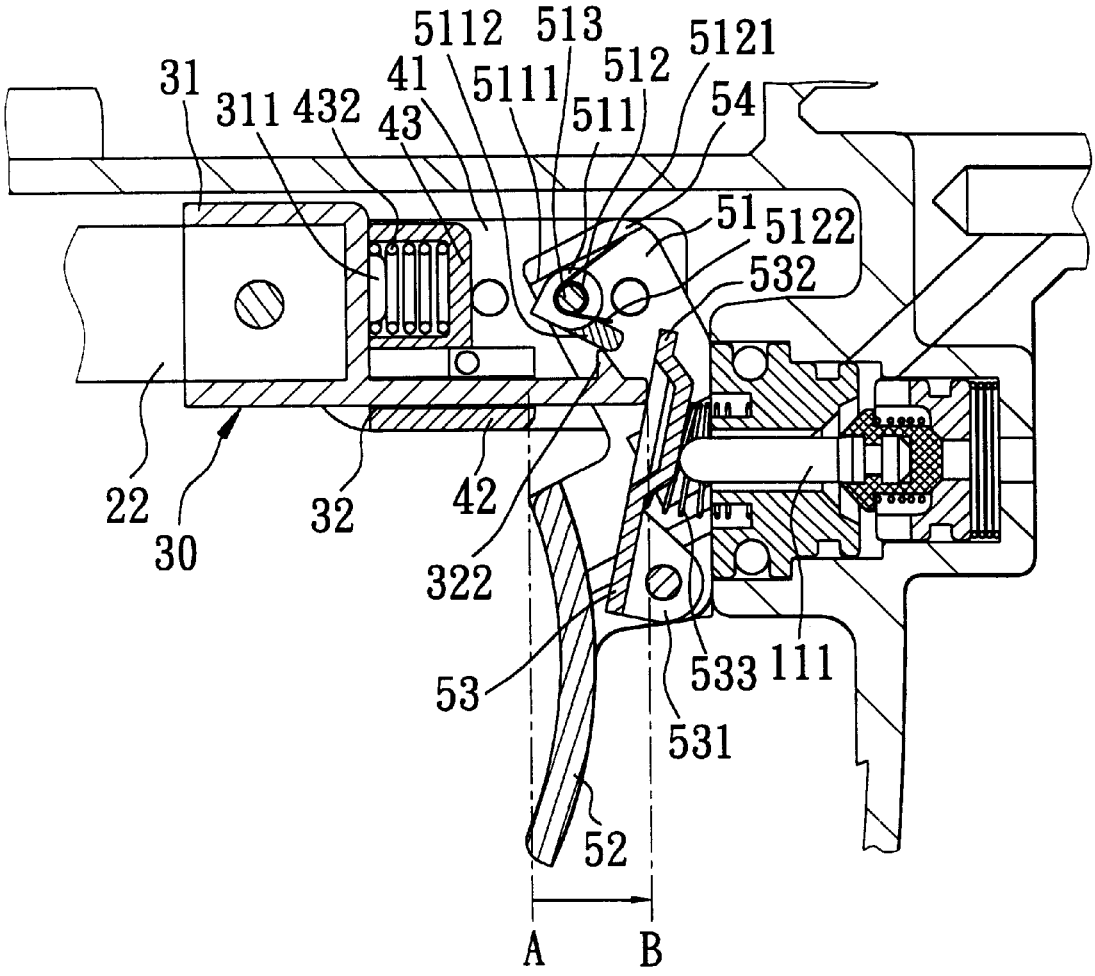
FIG. 7 is a fragmentary sectional view of the preferred embodiment, in which the press member moves to the rear limit position after the trigger member moves to the actuated position during the continuous shooting operation.

When it is desired to perform a continuous shooting operation, the actuation lever 52 is pressed so as to move from the non-actuated position (C) shown in FIG. 3 to the actuated position (D) shown in FIG. 6. Referring to FIG. 7, subsequently, the safety rod 20 (see FIGS. 1 and 2) is pressed against the wall 60 (see FIG. 1), thereby permitting movement of the press member 30 from the front limit position (A) to the rear limit position (B), during which the free end 5112 of the hook member 511 is pushed by the barb 322 to rotate counterclockwise against the biasing action of the torsion spring 512. When the press member 30 moves to the rear limit position (B), the free end 532 of the pushing plate 53 turns rearward so as to move the valve rod 111 to the compressing position, thereby permitting a nail shooting operation. Thereafter, the safety rod 20 (see FIG. 1) is removed from the wall 60 (see FIG. 1) so that the press member 30 is biased to the front limit position (A) shown in FIG. 6, after which the safety rod 20 (see FIG. 1) can be pressed against the wall 60 (see FIG. 1) so as to once again move the press member 30 to the rear limit position (B) shown in FIG. 7. In this way, the valve rod 111 can reciprocate between the non-compressing position and the compressing position, thereby shooting nails continuously from the seat 121.

When performing the single shot or continuous shooting operation, the safety rod 20 and the actuation lever 52 can be actuated using only one hand that holds the handle 11. Accordingly, the gun of this invention can be easily operated.

With this invention thus explained, it is apparent that numerous modifications and variations can be made without departing the scope and spirit of this invention. It is therefore intended that this invention be limited only as indicated by the appended claims.

I claim:

1. A pneumatic nail-driving gun comprising:

a gun body including a handle with a movable valve rod that is biased to a non-compressing position and that is movable to a compressing position, and a barrel having a rear portion that is attached to said handle, and a front portion with a nail-shooting seat that is adapted to shoot a nail therefrom when said valve rod moves from the non-compressing position to the compressing position;

a safety rod disposed movably on a front end of said barrel and having a rear end and a front end that is adapted to abut against a wall, into which the nail is to be driven;

a press member connected fixedly to a rear end of said safety rod and having a rear pressing section with a fixed barb;

a biasing unit for biasing said press member to a front limit position relative to said barrel, said press member being movable relative to said barrel to a rear limit position when said front end of said safety rod is adapted to be pressed forcibly against the wall; and a trigger assembly including a trigger member disposed pivotally on said barrel and having a fixed actuation lever, which is biased to a non-actuated position relative to said barrel and which is rotatable to an actuated position that is located behind the non-actuated position, a spring-biased hook member mounted pivotally on said trigger member, a pushing plate disposed pivotally on said trigger member and located in front of said valve rod, said pushing plate having a free end, and a spring for biasing said free end of said pushing plate away from said valve rod to abut against said rear pressing section of said press member, said pushing plate being pushed rearward by said press member and said trigger member against biasing action of said spring, thereby contacting and moving said valve rod to the compressing position when said press member moves to the rear limit position and when said actuation lever moves to the actuated position;

wherein when said safety rod is first pressed forward against the wall so as to move said press member to the rear limit position and when said actuation lever is subsequently pressed rearward to the actuated position for moving said valve rod from the non-compressing position to the compressing position so as to perform a nail shooting operation, said hook member is turned to a position adjacent to and in front of said barb of said press member so as to prevent forward movement of said barb, thereby retaining said press member at the rear limit position to prevent forward movement of said valve rod from the compressing position and thus a subsequent nail shooting operation, thereby resulting in a single shot operation;

wherein when said actuation lever is first pressed rearward to the actuated position and when said safety rod is subsequently pressed forward against the wall, thereby moving said valve rod so as to perform the nail shooting operation, said barb contacts said hook member in such a manner to permit forward movement of said barb, after which said safety rod can be once again pressed against the wall, thereby permitting movement of said press member from the front limit position to the rear limit position, with said actuation lever maintained at the actuated position, to commence with a subsequent nail shooting operation so as to result in a continuous shooting operation.

2. The nail driving gun as claimed in claim 1, further comprising a positioning seat, which includes two parallel side plates that are disposed fixedly on said barrel and that are formed respectively with a pair of aligned slide slots, a bottom plate that is connected fixedly to and that is perpendicular to said side plates, a limiting member that interconnects said side plates fixedly and that is spaced apart from said bottom plate, and a slide rod that is received slidably within said slide slots in said side plates, said rear pressing section of said press member being shaped as a plate, which is superimposed on said bottom plate of said positioning seat and which is received fittingly and movably within a space that is defined between said bottom wall and said limiting member, said slide rod being disposed in front of said barb, thereby preventing forward removal of said press member from said positioning seat.

3. The nail driving gun as claimed in claim 2, wherein said limiting member has a front surface, which is formed with a recess, said press member including a front casing element, which is connected fixedly to a front end of said rear pressing section and which abuts against said limiting member so as to prevent further rearward movement of said press member when said press member is disposed at the rear limit position, said front casing element being formed with a rearwardly extending integral projection, said biasing unit being configured as a coiled compression spring, which has a front end that is sleeved fixedly on said projection of said front casing element, and a rear end that is confined within said recess in said limiting member of said positioning seat so as to bias said press member away from said positioning seat.

4. The nail driving gun as claimed in claim 1, wherein said hook member includes an abutment face unit and a free end, said trigger member further including an integral stop element, said trigger assembly including a torsion spring, which is disposed between said hook member and said trigger member and which biases said hook member to rotate relative to said trigger member so as to move said abutment face unit of said hook member to abut against said stop element of said trigger member, thereby locating said free end of said hook member adjacent to and in front of said barb to prevent forward movement of said press member when said press member is disposed at the rear limit position and when said actuation lever is disposed at the actuated position during the single shot operation.

* * * * *